US005901488A

United States Patent [19]

Oberlin

[11] Patent Number: 5,901,488

[45] Date of Patent: May 11, 1999

[54] PIEZOID ELECTRICAL GUN TRIGGER

[75] Inventor: Richard P. Oberlin, Phoenix, Md.

[73] Assignee: AAI Corporation, Cockeysville, Md.

[21] Appl. No.: 09/001,688

[22] Filed: Dec. 13, 1997

[51] Int. Cl.[6] ..... F41A 19/00

[52] U.S. Cl. ..... 42/84; 89/28.05; 89/28.01

[58] Field of Search ..... 42/84; 89/28.05, 89/28.01

[56] References Cited

U.S. PATENT DOCUMENTS

| | | | |
|---|---|---|---|
| 2,978,827 | 4/1961 | Rouby | 42/84 |
| 2,993,291 | 7/1961 | Rouby | 42/84 |
| 3,208,181 | 9/1965 | Calhoun et al. | 42/84 |
| 3,899,845 | 8/1975 | Wild et al. | 42/69 A |
| 4,109,557 | 8/1978 | Zaucha | 89/7 |
| 4,510,844 | 4/1985 | Fritz et al. | 89/135 |
| 5,485,786 | 1/1996 | Hesse et al. | 102/202.5 |

*Primary Examiner*—Charles T. Jordan
*Assistant Examiner*—Meeva Chelliah
*Attorney, Agent, or Firm*—Venable Baetjer Howard & Civiletti, LLP

[57] ABSTRACT

A method and apparatus for firing a firearm. A trigger is pulled which causes a hammer to rotate away from an electrical power source. After the hammer passes its maximum position, it is released by the trigger releases it, thereby causing the hammer to strike the electrical power source. The force from the hammer causes electrical energy to flow from the electrical power source to an electrically activated primer, thereby igniting the primer.

22 Claims, 1 Drawing Sheet

PIEZOID ELECTRICAL GUN TRIGGER

CROSS REFERENCE TO RELATED APPLICATIONS

This application is related to the following applications: "One-Shot High-Output Piezoid Power Supply" by Richard P. Oberlin and Robert T. Soranno; "Ultra Low-Power Fast Start Precision Oscillator" by Richard P. Oberlin; "Muzzle Velocity Sensor" by Richard P. Oberlin and Doug R. Cullison; "Accurate Ultra Low-Power Fuze Electronics" by Richard P. Oberlin and Robert T. Soranno; and "Self Correcting Inductive Fuze Setter" by Richard P. Oberlin and Robert T. Soranno, each of which is filed concurrently herewith, commonly owned, and incorporated herein by reference.

BACKGROUND OF THE INVENTION

The present invention relates to an improved firing mechanism for firearms.

Previous methods for causing a projectile to be fired from a gun included use of a percussion activated primer and a hammer. When the hammer struck the primer, the primer fired, which in turn ignited gunpowder in the projectile. As a result, the projectile was propelled down the barrel and exited the gun.

In addition to mechanically firing a cartridge, previous methods also involved electrically firing a cartridge by using a battery, a switch and an electrically activated primer in the ammunition instead of a conventional hammer/firing pin arrangement. In those situations, the shooter pulled the trigger which acted upon the switch to connect the battery to the detonator and thus to cause the projectile to be fired. For example, U.S. Pat. No. 3,854,231 (Broyles) describes a small arms weapon in which the electrical power for firing the gun is provided by a rechargeable storage battery. In addition, provision is made, in the form of additional circuitry, for recharging the battery.

Likewise, U.S. Pat. No. 5,625,972 (King) teaches the use of a gun provided with an electronically fired cartridge. The cartridge or projectile located in the gun includes a chamber with an explosive and a primer cap with a heat activated primer. A fuse wire of appropriate electrical resistance extends through the primer for igniting the primer. It is connected in series with a switch and a battery. When the switch is closed, the circuit is completed causing electrical current to flow through the fuse wire. This causes the wire to heat up, thereby igniting the primer.

However, there are many problems associated with the use of a battery to supply the energy detonate the primer. First, the battery has limited life and, therefore, has to be either replaced or recharged periodically.

Second, the battery weighs a significant amount.

And third, batteries generate a low voltage (typically 9 volts) and a good electrical contact has to be made to both the case and to the primer electrode each time a new cartridge is loaded. As a result, firing reliability is adversely affected by corrosion, erosion, and a build-up of propellant residue as the gun ages and as more rounds are fired between cleanings.

Piezoelectric elements have been used in weapon systems. For example, U.S. Pat. No. No. 4,510,844 (Fritz) discloses a firing mechanism for handguns which uses a piezo-voltage generator as one of the sources of ignition energy. However, in order for the Fritz ignition system to work, the breech block piece 22 must be correctly positioned. Another difference between Fritz and the disclosed invention is that the striking piece 5 in Fritz moves in a linear, and not a circular path. Furthermore, although the Fritz patent says that energy from the piezo generator is delivered to a detonator, no detail is given as to how the detonator is activated.

SUMMARY AND OBJECTS OF THE INVENTION

The present invention uses a hammer like device that is released by the trigger and which strikes a piezoid (a piezo-electric ceramic) that then generates a high voltage pulse that is applied to an electrically sensitive primer, that is, a primer that requires electrical energy for activation.

The main advantages are: (1) no battery is required that would have to be replaced or recharged periodically; (2) a much higher voltage is utilized which permits safer and more reliable operation because the higher voltage can jump across gaps and can puncture through thin non-conducting dirt films (additionally, a good low-resistance electrical contact is not required); and, (3) when a hammer like mechanism is added back into the weapon, it does not have to be located with any specific relationship to the breech or barrel and can be readily isolated from back blast and powder residue accumulation.

DESCRIPTION OF THE PREFERRED EMBODIMENT

Figure 1A:
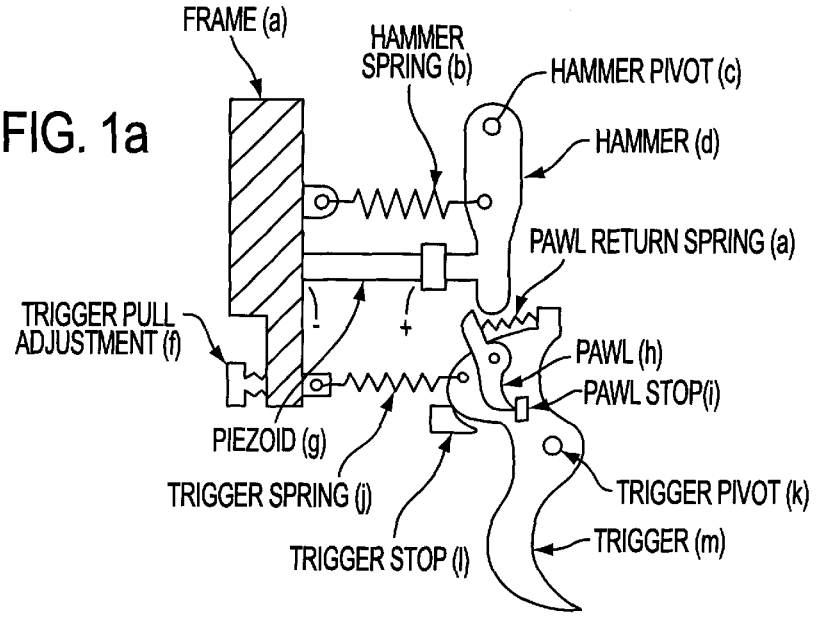
FIG. 1A is a mechanical drawing of the trigger mechanism in the rest/activate position.
Figure 1B:
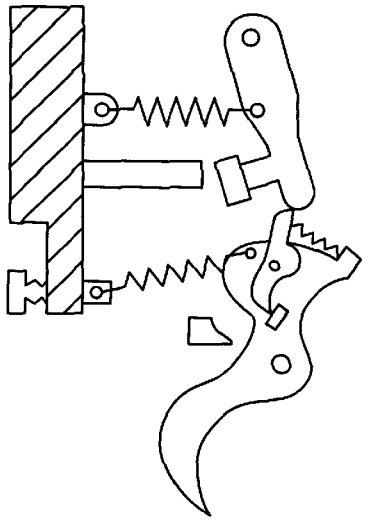
FIG. 1B is a mechanical drawing of the firing mechanism in the fully cocked position.
Figure 2:
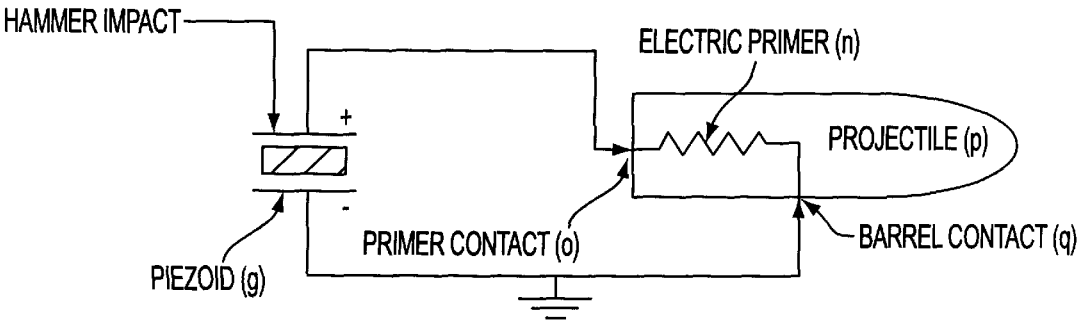
FIG. 2 is an electrical schematic of the firing mechanism.

The operation of the piezoid electrical gun trigger according to the present invention is as shown in FIGS. 1A and 1B and FIG. 2.

Trigger (m) and hammer (d) are normally returned to their rest positions (as shown in FIG. 1A) by their respective springs; (j) for the trigger and (b) for the hammer. Trigger (m) comes to rest against trigger stop (l) and hammer (d) comes to rest against piezoid (g) which is firmly anchored to weapon frame (a).

As the trigger (m) is squeezed (in the direction of the arrow connected to trigger (m)), it rotates about trigger pivot (k). The pull is adjustable by the combination of trigger pull adjustment screw (f) and trigger spring (j). This action causes hammer (d) to rotate about hammer pivot (c), thereby moving away from piezoid (g) and stretching hammer spring (b), thus storing energy in the spring.

As trigger (m) is continuously squeezed, hammer (d) reaches its maximum position as shown in FIG. 1B. When the hammer (d) passes this position, pawl (h) clears hammer (d), releasing the hammer (d). Hammer (d) is then accelerated towards its rest position by hammer spring (b) and strikes piezoid (g) while trigger (m) continues to move until it is stopped by the edge of trigger stop (l).

The resulting impact and rapid deceleration of hammer (d) by the piezoid (g) causes piezoid (g) to compress slightly (a few thousands of an inch). This causes piezoid (g) to generate a high voltage (typically hundreds to thousands of volts). The voltage can be tailored to any desired value by changing the piezoid layer thickness. Generally several hundred volts would be utilized. Since air has a nominal dielectric strength of 30 volts/mil, 600 volts could jump a gap of 20 mils and/or breakdown a nonconducting film of several mils. The total amount of energy available is proportional to piezoid volume and decelerating pressure (10's of thousands of ergs are readily generated).

The resulting voltage out of the piezoid is applied to an electrically activated primer (n). This causes primer (n) to fire, which in turn ignites propellant in projectile (p). As a result, projectile (p) is propelled down the barrel and exits the gun. The electrical path taken by the voltage is shown in FIG. 2. The electrically stimulated primer (n) has a contact (o) which is electrically connected to piezoid (g). The impact from the hammer causes the piezoid to compress and generate hundreds to thousands of volts causing electrical current to flow to the electrically activated primer (n) in projectile (p) via contact (o), and then exiting the primer (n) through gun barrel contact (q) which is located on the projectile's (p) outer casing.

Finally, when trigger (m) is released, it is rotated towards the rest position shown in FIG. 1A by trigger spring (j) until it is stopped by trigger stop (l). During the trigger's return, pawl (h) is deflected by hammer (d) which has returned to its rest position after striking the piezoid (g). As the pawl (h) passes hammer (d) during the trigger (m) return, it is released and the pawl return spring (e) pushes the pawl (h) back to its rest position against pawl stop (i).

What is claimed is:

1. A gun trigger, comprising:

a piezoid;

a trigger;

a hammer positioned between said trigger and said piezoid; and a primer which is electrically coupled to said piezoid, whereby when said trigger is squeezed, it causes said trigger to engage said hammer causing said hammer to first move away from said piezoid and then, after said hammer passes its maximum position, said trigger releases said hammer to strike said piezoid, thereby causing electrical energy to flow from said piezoid to said primer, thereby igniting said primer.

2. The gun trigger according to claim 1, wherein said hammer is rotatably positioned between said trigger and said piezoid.

3. The gun trigger according to claim 2, wherein said piezoid is a piezoid crystal having a first and a second terminal.

4. The gun trigger according to claim 2, wherein said primer is electrically activated.

5. The gun trigger according to claim 4, wherein said electric primer has a first contact, a second contact and an internal resistance, whereby said electrical current generated by said piezoid can flow through said internal resistance.

6. The gun trigger according to claim 5, wherein said first contact is a primer contact and wherein said second contact is a barrel contact which is connected to ground potential.

7. The gun trigger according to claim 5, wherein one of said terminals of said piezoid is connected to one of said contacts of said primer and the other of said terminals of said piezoid is connected to the other contact of said primer.

8. The gun trigger according to claim 1, wherein said hammer is rotatably positioned between said trigger and said piezoid.

9. The gun trigger according to claim 8 wherein said hammer further comprises a hammer pivot around which said hammer rotates and said trigger further comprises a trigger pivot around which said trigger rotates.

10. The gun trigger according to claim 9, wherein said piezoid is a piezoid crystal having a first and a second terminal.

11. The gun trigger according to claim 9, wherein said primer is electrically activated.

12. The gun trigger according to claim 11, wherein said electric primer has a first contact, a second contact and an internal resistance, whereby said electrical current generated by said piezoid can flow through said internal resistance.

13. The gun trigger according to claim 12, wherein said first contact is a primer contact and wherein said second contact is a barrel contact which is connected to ground potential.

14. The gun trigger according to claim 12, wherein one of said terminals of said piezoid is connected to the first contact of said primer and the other of said terminals of said piezoid is connected to the second contact of said primer.

15. The gun trigger according to claim 6, wherein one of said terminals of said piezoid is connected to one of said contacts of said primer and the other of said terminals of said piezoid is connected to the other contact of said primer.

16. The gun trigger according to claim 13, wherein one of said terminals of said piezoid is connected to the first contact of said primer and the other of said terminals of said piezoid is connected to the second contact of said primer.

17. A gun trigger comprising:

a piezoid;

a frame;

a trigger;

a trigger spring connected between said trigger and said frame;

a trigger pull adjustment screw screwed into said frame, whereby the tension in said trigger spring can be adjusted by rotating said adjustment screw;

a hammer positioned between said trigger and said piezoid;

a hammer spring connected between said frame and said hammer;

a pawl rotatably connected to said trigger;

a pawl stop mounted to said trigger;

a pawl return spring connected between said pawl and said trigger;

a trigger stop; and a primer which is electrically coupled to said piezoid, whereby when said trigger is squeezed, it causes said pawl to engage said hammer causing said hammer to first rotate away from said piezoid and then, after said hammer passes its maximum position, said pawl clears said hammer thereby releasing said hammer causing said hammer to strike said piezoid, thereby causing electrical energy to flow from said piezoid to said primer, thereby igniting said primer.

18. A method of firing a gun, comprising the steps of:

compressing an piezoid thereby generating a voltage; and coupling said voltage to a primer, thereby igniting said primer.

19. The method according to claim 18, wherein said coupling further comprises inducing a current flow in said primer.

20. The method according to claim 18, wherein said compressing further comprises striking said piezoid with a hammer.

21. The method according to claim 19, wherein said compressing further comprises striking said piezoid with a hammer.

22. The method according to claim 20, wherein said compressing further comprises rotating said hammer and then striking said piezoid.

* * * * *

UNITED STATES PATENT AND TRADEMARK OFFICE

CERTIFICATE OF CORRECTION

PATENT NO. : 5,901,488

DATED : May 11, 1999

INVENTOR(S) : Richard P. Oberlin

It is certified that error appears in the above-identified patent and that said Letters Patent is hereby corrected as shown below:

On the title page, item [22] Filed: should read -- December 31, 1997 --.

Signed and Sealed this

Seventh Day of December, 1999

*Attest:*

Q. TODD DICKINSON

*Attesting Officer*

*Acting Commissioner of Patents and Trademarks*